US005311627A

United States Patent [19]

Koch et al.

[11] Patent Number: 5,311,627

[45] Date of Patent: May 17, 1994

[54] METHOD AND APPARATUS FOR DISCONTINUOUS WET TREATMENT OF A HANK OF FABRIC

[75] Inventors: Werner Koch, Erbach-Bullau; Gerd Kolmer, Erbach/Odw., both of Fed. Rep. of Germany

[73] Assignee: Bruckner Apparatebau GmbH, Erbach/Odw., Fed. Rep. of Germany

[21] Appl. No.: 46,771

[22] Filed: Apr. 13, 1993

[30] Foreign Application Priority Data

Apr. 15, 1992 [DE] Fed. Rep. of Germany ..... 4212674

[51] Int. Cl.[5] ..... D06B 3/26; D06B 3/28

[52] U.S. Cl. ..... 8/152; 68/22 R; 68/178; 226/118

[58] Field of Search ..... 8/152; 68/22 R, 176, 68/177, 178; 226/118

[56] References Cited

U.S. PATENT DOCUMENTS

| | | | |
|---|---|---|---|
| 2,378,333 | 6/1945 | Simonds | 68/176 X |
| 2,753,706 | 7/1956 | Franklin | 68/177 X |
| 3,700,404 | 10/1972 | Janisch et al. | 8/152 |
| 4,006,612 | 2/1977 | Thies | 68/177 |
| 4,020,658 | 5/1977 | Thies, Jr. | 68/177 X |
| 4,036,038 | 7/1977 | Aurich et al. | 68/178 X |
| 4,440,003 | 4/1984 | Koch | 68/177 X |
| 4,947,660 | 8/1990 | von der Eltz et al. | 68/177 X |
| 5,170,523 | 12/1992 | Scholl | 68/178 X |

FOREIGN PATENT DOCUMENTS

| | | | |
|---|---|---|---|
| 3734261 | 4/1989 | Fed. Rep. of Germany | 8/152 |

*Primary Examiner*—Philip R. Coe
*Attorney, Agent, or Firm*—Hopkins & Thomas

[57] ABSTRACT

The invention relates to the discontinuous wet treatment of a hank of fabric in at least one cycle of the fabric through a treatment compartment. In order to achieve a rapid and reliable wet treatment with a relatively simple construction, the treatment compartment is divided into two treatment chambers which lie parallel adjacent to one another, so that with each circulation of the fabric two sections of fabric running parallel to one another are treated simultaneously in two similar treatment chambers of the same treatment compartment which serve for the same type of treatment.

16 Claims, 3 Drawing Sheets

METHOD AND APPARATUS FOR DISCONTINUOUS WET TREATMENT OF A HANK OF FABRIC

FIELD OF THE INVENTION

The invention relates to a method of discontinuous wet treatment of a hank of fabric and to apparatus for discontinuous wet treatment of a hank of fabric.

BACKGROUND OF THE INVENTION

In such wet treatment knitted and woven textile materials in hank form are transported through a treatment compartment in at least one cycle and are thereby principally dyed, bleached or washed.

In this prior art which is generally known in practice, the entire length of the material or fabric is passed at least once through the treatment compartment so that it comes into contact with fresh solution, chemicals or also necessary mechanical influences and so that the necessary change of substances or solution can be brought about in this way. The aim is to work with relatively high circulation speeds.

High circulation speeds do indeed permit a relatively low solution ratio (the ratio of the quantity of material to the quantity of solution), so that treatment times and consumption of solution and of energy can be kept relatively low. However, high circulation speeds also have considerable disadvantages: uncertain running of the fabric often occurs (for example as a result of snarling or the like); high accelerations of the fabric often lead to undesirably great longitudinal tension; fundamental transport problems also occur with extremely light and extremely heavy materials; due to the influences of foam and chemicals an undesirable slippage can occur during transport of the material; furthermore, the surface of the fabric often undergoes an undesirable mechanical roughing.

Attempts have already been made to remedy some of the aforementioned disadvantages by assisting the transport of the fabric for circulation by blowing in air or inert gas and simultaneously introducing treatment solution. In this case particularly high circulation speeds are used. However, the expenditure on machinery is also particularly high.

SUMMARY OF THE INVENTION

The object of the invention, therefore, is to avoid the described disadvantages and to create a method according to the preamble to claim 1 as well as apparatus according to the preamble to claim 4 by means of which, using very reliable and relatively simple mechanical transport means, a hank of fabric can be subjected in a relatively short time to an intensive and gentle wet treatment.

Using the method according to the invention, the discontinuous wet treatment of a hank of fabric is carried out in such a way that in one or each circulation of the fabric two sections of fabric running parallel to one another are treated simultaneously in two similar treatment zones of the treatment compartment which lie adjacent to one another and serve for the same type of treatment. In other words, this means that a fabric to be treated which has, for example, been stitched together in a continuous length is acted upon simultaneously at two locations in one and the same treatment compartment by fresh solution, chemicals or also by mechanical treatment means. If this procedure is compared with the known method described above, then using the procedure according to the invention approximately double the quantity of material can be subjected to wet treatment (dyeing, bleaching, or the like) in the same circulation time as in the known method, or the same quantity of fabric can be treated in approximately half the time; furthermore, it is possible, using the same quantities of fabric and the same treatment times, to carry out particularly gentle treatment of the particular fabric by comparison with the known constructions.

In this method according to the invention a fabric which has preferably been stitched together in a continuous length can be subjected to wet treatment to a certain extent in two part-circulation systems which are arranged parallel and adjacent to one another. If this is again compared with known methods with very short circulation times which are achieved for example with a transport speed of 400 m/min, then in the construction according to the invention transport speeds of for example 200 m/min are sufficient, since two parallel sections of fabric can run parallel and simultaneously through the two treatment zones which lie adjacent to one another of one and the same treatment type or of one and the same treatment compartment.

In this case it is also advantageous if in several treatment cycles the fabric is guided over transport rollers and if as it passes from one treatment zone to the other at least some treatment solution is squeezed out of the fabric, as a result of which a particularly quick change of solution can be achieved.

The solution ratio in this method according to the invention can be chosen to be for instance in the range from 1:2.5 to 1:10.

In the apparatus according to the invention for discontinuous wet treatment of a hank of fabric, the treatment compartment is divided in a sensible manner into two treatment chambers for one and the same type of treatment which lie adjacent to one another and through which two sections of fabric run parallel and simultaneously. In this case the transport elements are arranged in the connection between the two treatment chambers.

It is also particularly advantageous if the two treatment chambers are arranged in the appertaining treatment compartment in such a way that in each case the inlet end of one treatment chamber lies immediately adjacent to the outlet end of the other treatment chamber and the connection between each outlet end and the adjacent inlet end is formed by a transport roller.

Furthermore, it is advantageous for the two treatment chambers of one treatment compartment to be formed by two material baskets with perforated walls and for these two material baskets to be suspended as a unit so that they swing like a pendulum balance. In this case a potentiometer is co-ordinated with this material basket unit in such a way that in the event of unequal material loads in the two material baskets of a pair a rotary or swinging movement of this material basket unit can be picked up by the potentiometer and a load equalisation control can be activated for the two material baskets. In this way an extremely secure and reliable circulation of fabric can be ensured by a uniform distribution of the two material baskets of a unit and thus an extremely uniform wet treatment can also be ensured.

BRIEF DESCRIPTION OF THE DRAWING

The invention will be explained below with the aid of the drawings, in which.

DETAILED DESCRIPTION

Figure 1:
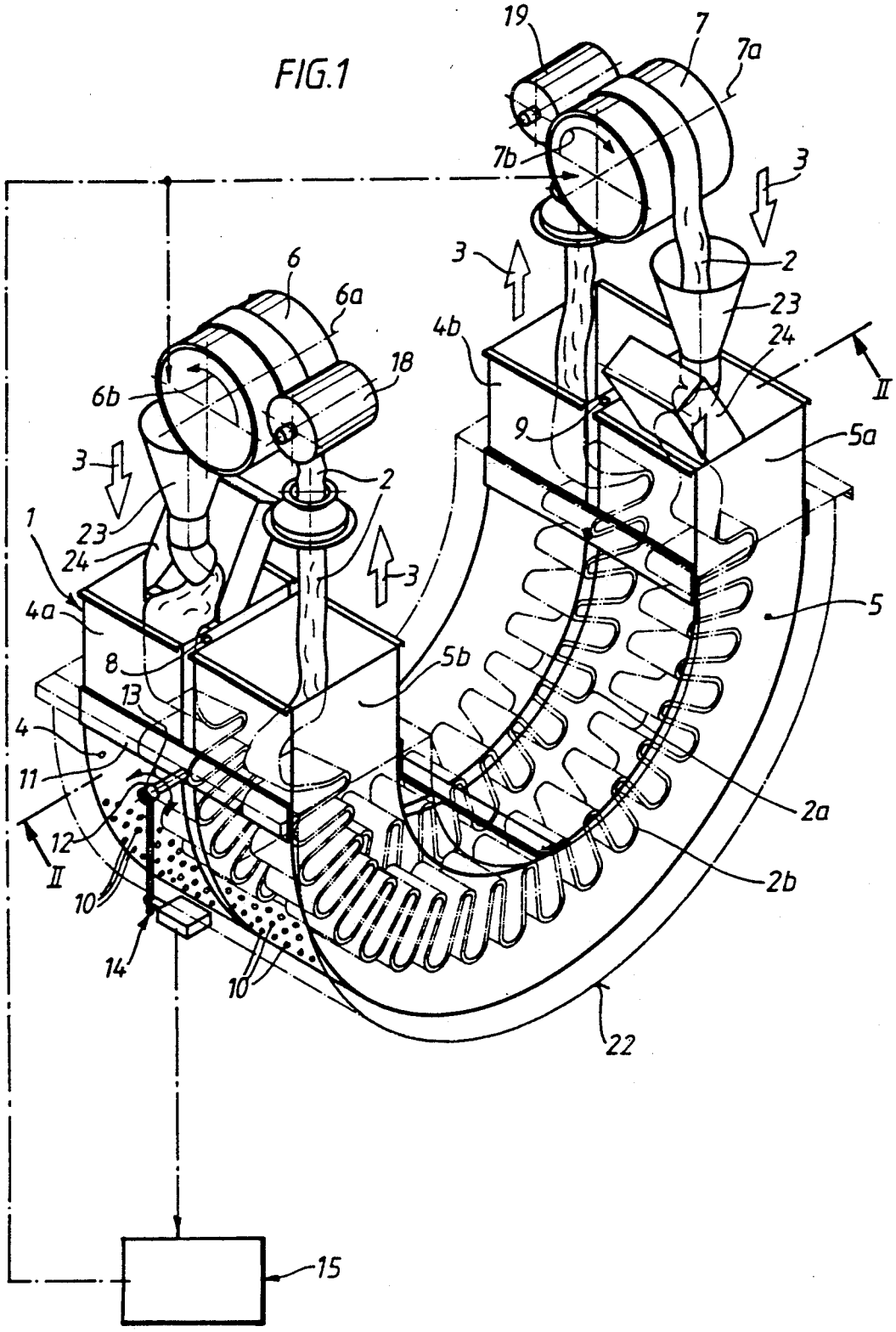
FIG. 1 shows a simplified perspective view of a discontinuous wet treatment apparatus according to the invention with a material basket unit.

The general construction of the apparatus according to the invention (discontinuous wet treatment apparatus) will be explained first of all with the aid of the perspective view in FIG. 1, in which only one treatment compartment 1 is shown which serves for wet treatment (particularly dyeing, bleaching, washing or the like) of a hank of fabric 2 which has preferably been stitched together in a continuous length and which is transported mechanically in the direction of the arrows 3 in at least one single circulation through the treatment compartment 1.

The treatment compartment 1 is divided into two treatment chambers 4, 5 for one and the same type of treatment through which two sections of fabric 2*a*, 2*b* run parallel and simultaneously. Transport elements which are preferably constructed as transport rollers 6, 7 and are arranged in the connection between the two treatment chambers 4, 5 provide for the mechanical transport of the fabric 2.

As can be seen in FIG. 1, each treatment chamber 4, 5 has an inlet end 4*a*, 5*a* respectively and an opposite outlet end 4*b*, 5*b* respectively, and in this case these two treatment chambers 4, 5 are co-ordinated in the appertaining treatment compartment in such a way that in each case the inlet end of one treatment chamber lies immediately adjacent to the outlet end of the other treatment chamber, i.e. the inlet end 4*a* of the treatment chamber 4 lies immediately adjacent to the outlet end 5*b* of the treatment chamber 5, whilst the outlet end 4*b* of the first chamber 4 lies immediately adjacent to the inlet end 5*a* of the second chamber 5. The connection between each outlet end 4*b*, 5*b* and the adjacent inlet end 4*a*, 5*b* respectively is then formed by the appertaining transport roller 6, 7 respectively which lies with its axis of rotation 6*a*, 7*a* respectively preferably parallel to and appropriately spaced above the separating walls 8, 9 which lie immediately against one another between the two treatment chambers 4, 5.

The two treatment chambers of each treatment compartment 1 are preferably formed by two material baskets 4, 5 with perforated walls (cf. perforation indicated at 10 in FIG. 1). These two material baskets 4, 5 are preferably suspended as a unit (pair) so that they swing like a pendulum balance, as is indicated in FIG. 1 by a type of balance beam 11 and a pendulum axis 12, about which the material basket unit 4, 5 can rotate or swing in the direction of the double arrow 13 in the event of unequal material loads.

A potentiometer 14 is co-ordinated with this material basket unit 4, 5 in such a way that in the event of unequal material loads in the two material baskets 4, 5 a rotary or swinging movement of the material basket unit occurs in the direction of the heavier or fuller material basket. This swinging movement in one or the other direction of the double arrow 13 can be picked up by the potentiometer 14, as a result of which a corresponding measurement signal is passed on to a control arrangement 15 which is only indicated in simplified form, from which a corresponding control signal is passed to one of the two transport rollers 6 or 7 for the purpose of activating a load equalisation control for the two material baskets 4, 5. The latter can be achieved in a simple manner by a corresponding alteration in the speed of rotation of at least one of the two transport rollers 6 or 7. For this purpose the two transport rollers 6, 7 are provided with separate drives each with a separate drive motor 16, 17 respectively (FIG. 2), so that they can be driven at a separately variable speed of rotation in the direction of the arrows 6*b*, 7*b* respectively. The potentiometer 14 is in control connection with these drive motors via the control arrangement 15.

Figure 2:
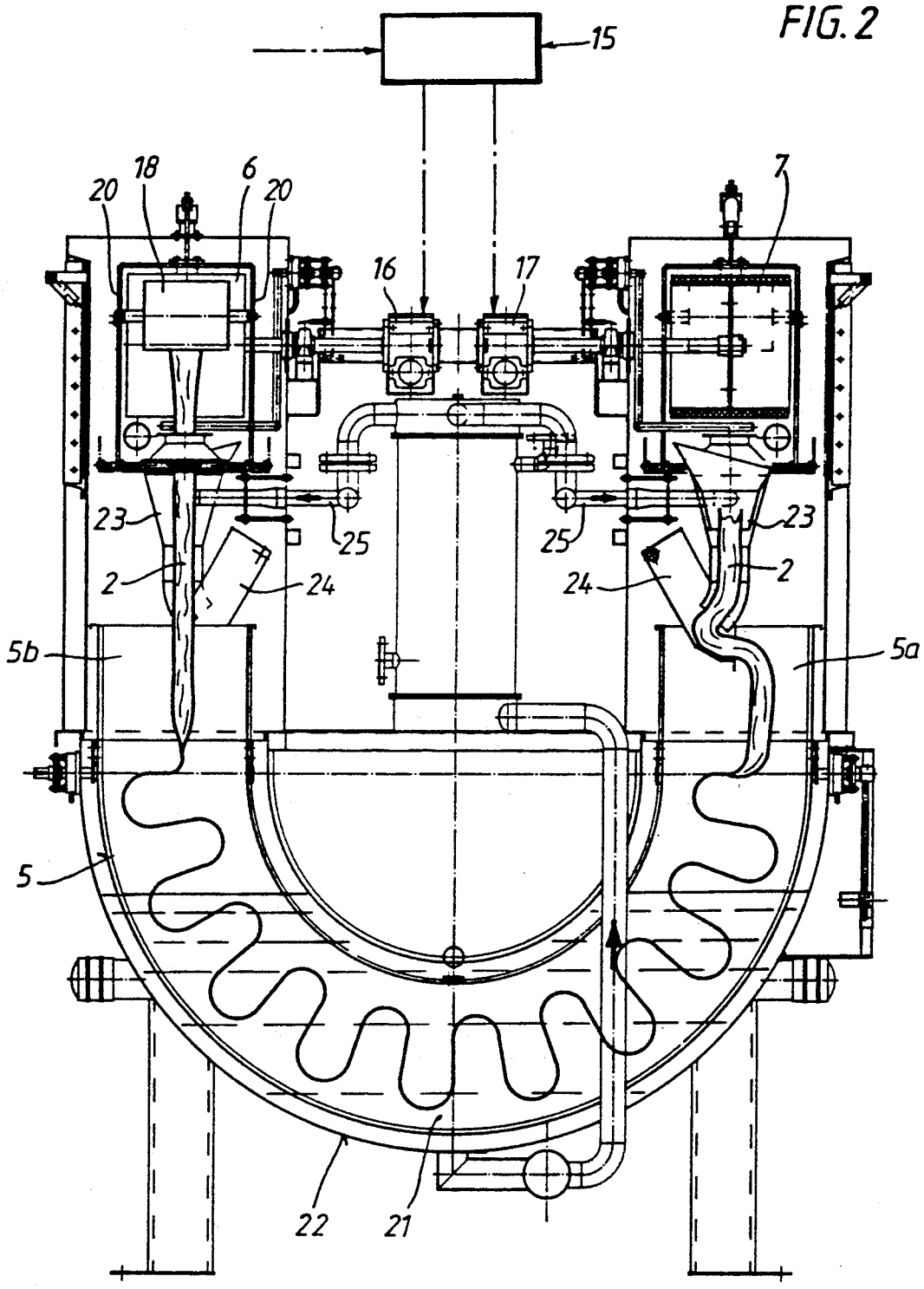
FIG. 2 shows a vertical sectional view through the apparatus according to FIG. 1 (approximately along the line II—II in FIG. 1)

It may also be seen from FIGS. 1 and 2 that a press-out roller 18, 19 is co-ordinated with each transport roller 6, 7 respectively. As can be seen in FIG. 2 in the case of the left-hand press-out roller 18, each press-out roller 18, 19 is mounted so as to be freely rotatable in swivel arms 20 in such a way that each press-out roller 18, 19 can be pressed as desired or if required against the appertaining transport roller 6, 7 respectively, so that a squeezer gap is constructed between the two co-operating pairs of rollers 6 and 18 or 7 and 19 respectively through which the fabric 2 to be treated can be transported, so that if required at least a part of the treatment solution carried with it can be squeezed out of the fabric 2, and this solution which has been squeezed out can then flow back into the outlet end 4*b*, 5*b* of the appertaining material basket 4, 5 respectively lying below it.

In so far as the construction of the material baskets 4, 5 is concerned, these can be produced in any suitable manner which is adapted for the treatment procedure according to the invention. However, it is particularly preferred for each of the material baskets 4, 5 to be constructed as U-shaped channels of equal size, as shown in FIGS. 1 and 2.

Furthermore, it is preferred for the material basket unit with the baskets 4, 5 to be arranged in a common treatment tank 22 which contains the treatment solution 21. By an advantageous type of the perforation of the material basket walls as already mentioned above, on the one hand sufficient treatment solution 21 penetrates into each material basket 4, 5 which is immersed in the treatment solution, and on the other hand this perforation 10 of the material basket walls simultaneously ensures an extremely good intermixing of the treatment fluid during the treatment process.

With the aid of FIGS. 1 and 2 it is also shown that a nozzle-shaped overflow funnel 23 through which the hank of fabric 2 runs is arranged in the region of the upper inlet end 4*a*, 5*a* of each treatment chamber or of each material basket 4, 5 respectively and also below the appertaining transport roller 6, 7 respectively. A baffle plate 24 which takes up the hank of fabric and passes it on is also preferably arranged below each overflow funnel 23. In this case each overflow funnel is constructed for aligned introduction of the hank of fabric into the appertaining treatment chamber or the material basket 4, 5 which forms it, each overflow funnel 23 being connected to a solution supply pipe 25.

The construction and arrangement of each overflow funnel 23 and the co-ordination thereof with the appertaining baffle plate 24 serve in an optimal manner to ensure that the section of the bank of fabric 2 coming from the appertaining transport roller 6 or 7 is introduced neatly and with satisfactory laying of folds into the inlet end of the appertaining material basket 4, 5 respectively. In this case it is sufficient for the overflow funnel 23 and the baffle plate 24 arranged downstream of it to be fixed or co-ordinated with one another in a suitable manner. However, it can also be advantageous if the overflow funnel 23 and the baffle plate 24 are held so as to be adjustable in a suitable manner, so that if necessary a subsequent readjustment of these parts is possible.

Figure 3:
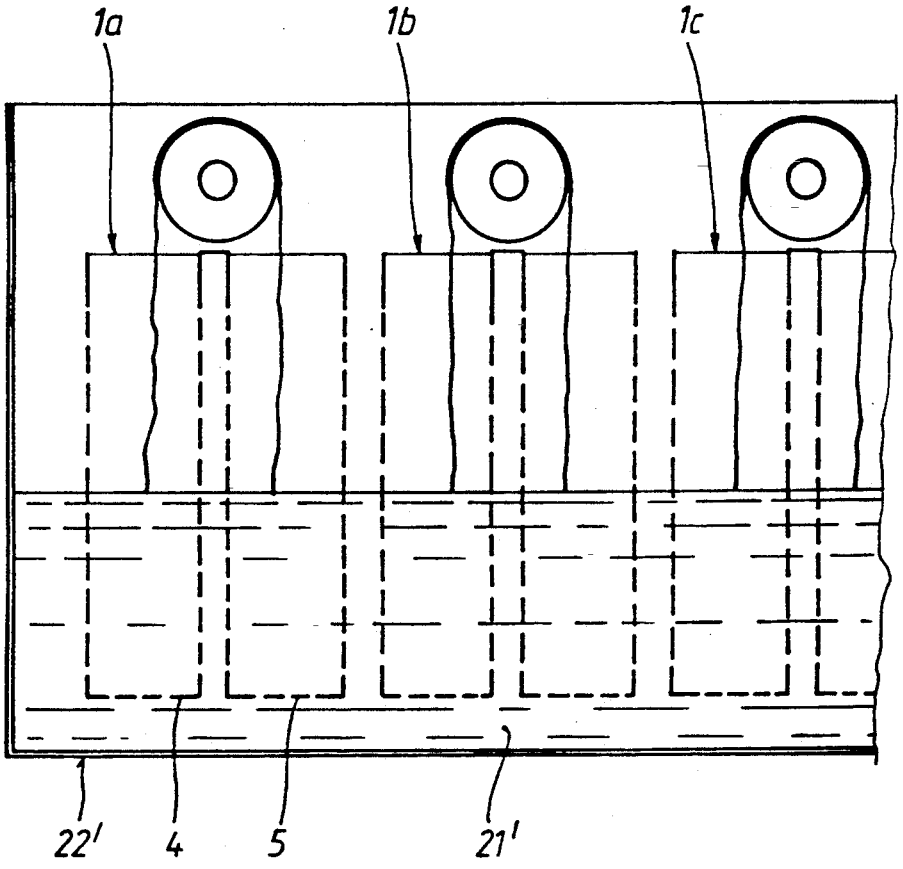
FIG. 3 shows a greatly simplified schematic view of a wet treatment apparatus with several co-ordinated material basket units.

With the aid of the simplified schematic representation in FIG. 3 it can also be seen that the discontinuous wet treatment apparatus according to the invention, such as has been explained above on the basis of one single material basket unit with the material baskets 4 and 5 (FIGS. 1 and 2), can also be equipped with several material basket units 1*a*, 1*b*, 1*c* in one and the same treatment tank 22', in which case these material basket units 1*a*, 1*b*, 1*c* are then arranged in modular fashion adjacent to one another in the common treatment tank 22' and can be operated for the same process of treatment of several hanks of fabric which run parallel and circulate continuously in the same bath 21'. This is of interest principally for larger installations or apparatus, in which case each material basket unit 1*a*, 1*b*, 1*c* can then operate with an optimum material content (degree of filling with material). In this case two each material basket unit again consists of two material baskets 4, 5 with perforated walls, as explained in detail above with the aid of FIGS. 1 and 2.

Irrespective of whether the apparatus is constructed with only one single material basket unit 4, 5 or with several material baskets of similar construction and lying adjacent to one another in modular fashion, each of these material basket units operates according to the same procedure described above, so that with each circulation of the fabric two sections of the fabric 2*a*, 2*b* running parallel to one another are treated simultaneously in two similar treatment zones (treatment chambers or material baskets 4, 5) of the treatment compartment 1 which lie adjacent to one another and serve for the same type of treatment, preferably stitched together in a continuous hank and circulating any number of times. During these circulations it can happen, for example due to slippage on the transport rollers 6, 7, that different filling quantities of material are contained in the two material baskets 4, 5 of a unit. This can be equalised in a simple manner by the swinging suspension of each material basket unit and the appertaining control by the potentiometer 14, each material basket unit being held or suspended like a pendulum balance. If, for example, in this case less material is located in the left-hand material basket of a unit than in the right-hand one, then this material basket unit tips in the direction of the right-hand material basket. This rotary or swinging movement about the pendulum axis 12 is picked up with the aid of the potentiometer 14, so that by means of the control arrangement 15 the drive for the extraction speed of the right-hand material basket is corrected upwards and if necessary at the same time the extraction speed for the other transport roller on the left-hand material basket is corrected downwards.

The method according to the invention should be further clarified—for example with the aid of FIG. 1—by an example with actual figures:

It may be assumed that material (a length of fabric) amounting to 150 kg is located in a material basket unit; the weight per meter run is 200 g/m, thus 5 linear meters weigh 1 kg, so that the 150 kg of material represent a fabric length of 750 m.

The circulation time aimed for should be a maximum of 4 minutes. If the fabric defined above were to be subjected to wet treatment using one of the known methods described in the introduction, the transport speed for the circulation of the fabric would have to be at least 187.5 m/min to enable the entire length of fabric to run once through the bath.

Since in the method according to the invention two sections of fabric running parallel to one another are treated simultaneously in the described manner in two similar treatment zones (material baskets 4,5) of the same treatment compartment 1 which lie adjacent to one another, the fabric only has to be transported at a maximum transport speed of 93.75 m/min to enable the entire length of fabric to pass completely through the bath once in the said 4 minutes. On the other hand, if the method according to the invention is operated at the same circulation speed as the aforementioned known methods, that is to say at 187.5 m/min, then the circulation time for the entire fabric (with treatment according to the invention) falls to 2 minutes, so that the wet treatment process can then take place in approximately half the time, compared with the known methods.

If this is then compared with the possibility of coordinating several such material basket units in modular fashion in one single common treatment tank, then the wet treatment capacity of the apparatus extended in this way is multiplied by the number of material basket units used.

While the preferred embodiment of the invention has been shown and described, it will be understood by those skilled in the art that variations and modifications thereof can be made without departing from the spirit and scope of the invention as set forth in the following claims.

We claim:

1. In a process of discontinuous wet treatment of a continuous length of a hank of fabric (2) with a liquid treatment solution wherein sections of fabric (2a, 2b) run parallel and simultaneously through adjacent treatment chambers (4,5) of a liquid-containing treatment compartment (1), the improvement therein of:

transporting the sections of fabric out of each treatment chamber and into the other treatment chamber;

detecting the load of the hank of fabric in each treatment chamber;

in response to detecting the load of the hank of fabric being greater in one treatment chamber than the load of the hank of fabric in the other treatment chamber, transporting the section of fabric out of the treatment chamber having the larger load at a greater rate than transporting the other section of fabric out of the treatment chamber having the smaller load.

2. The process claimed in claim 1 and further comprising joining the sections of the fabric in a continuous hank for the treatment in the treatment compartment.

3. The process claimed in claim 1, and wherein the step of transporting the sections of fabric out of each treatment chamber comprises the step of guiding the fabric over transport rollers, and as the fabric passes from one treatment chamber to the other, removing at least some liquid treatment solution from the fabric.

4. Apparatus for discontinuous wet treatment of a hank of fabric (2), comprising a treatment compartment (1) with which mechanical transport elements (6, 7) are coordinated for circulation of the hank of fabric (2) through said treatment compartment, said treatment compartment (1) being divided into parallel treatment chambers (4, 5) mounted adjacent one another through which sections of fabric are moved simultaneously for substantially the same type of treatment of the fabric sections, means (11, 12) for pivotally supporting said treatment chambers, said transport elements (6, 7) being arranged between said treatment chambers for moving the sections of fabric through each of said treatment chambers, detection means (14) for detecting an imbalance of the fabric load in said treatment chambers, and control means (15) responsive to said detection means for adjusting the operation of at least one of said transport elements to adjust the speed of movement of the section of the hank of fabric through its treatment chamber to equalize the imbalance of the fabric load between said treatment chambers.

5. Apparatus as claimed in claim 4 and wherein said treatment chambers (4, 5) are arranged in said appertaining treatment compartment (1) such that an inlet end (4*a*, 5*a*) of one of said treatment chambers (4, 5) lies immediately adjacent an outlet end (5*b*, 4*b*) of said other treatment chamber with one of said transport rollers positioned between each outlet end and its adjacent inlet end for transporting the fabric between each outlet end and its adjacent inlet end.

6. The apparatus as claimed in claim 5 and further comprising an overflow funnel (23) mounted between each of said inlet ends of each of said treatment chambers and said transport roller therefor, and through which the hank of fabric (2) is passed for aligned introduction of the hank of fabric into its appertaining treatment chamber, and a solution supply pipe (25) connected to said overflow funnel for supplying a flow of solution to the fabric.

7. Apparatus as claimed in claim 6, and further comprising a baffle plate (24) positioned below said overflow funnel and adapted to receive and pass on the hank of fabric.

8. The apparatus as claimed in claim 7, and wherein said overflow funnel (23) and baffle plate (24) are held so as to be adjustable.

9. Apparatus as claimed in claim 5, and wherein said treatment chambers of said treatment compartment (1) comprise a pair of material baskets (4, 5) having perforated walls and suspended as a unit so as to swing like a pendulum balance, and wherein said means for detecting an imbalance in one of said treatment chambers comprises a potentiometer (14) coordinated with said material basket unit such that in the event of unequal material loads in said two material baskets (4, 5) a swinging movement of the material basket unit can be detected by said potentiometer and a load equalisation control for said material baskets activated.

10. Device as claimed in claim 9, and wherein said transport rollers (6, 7) each include separate drives (16, 17) mounted between said material baskets (4, 5) and which can be driven at a variable speed, said drives being in control connection with said potentiometer (14).

11. Apparatus as claimed in claim 9, and wherein said material baskets (4, 5) each comprise substantially U-shaped channels of approximately equal size.

12. Apparatus as claimed in claim 9, and wherein said material baskets (4, 5) are arranged in a common treatment tank (22, 22') containing treatment solution (21).

13. Apparatus as claimed in claim 12, and further comprising a series of material basket units arranged in modular fashion adjacent one another in said treatment tank and operable for treatment of several hanks of fabric which run parallel.

14. Apparatus as claimed in claim 5, and further comprising a press-out roller (18, 19) co-ordinated with each transport roller (6, 7), said press-out rollers being mounted so as to be freely rotatable in swivel arms (20) and pressed against an appertaining transport roller (6 or 7), forming a squeezer gap for the transported fabric (2).

15. The process of claim 1 and wherein the step of detecting the load of the hank of fabric in each treatment chamber comprises balancing the treatment chambers and detecting an imbalance of the treatment chambers.

16. Apparatus for discontinuous wet treatment of a hank of fabric (2) comprising:

a treatment compartment (1) divided into parallel treatment chambers (4, 5) mounted adjacent each other for receiving sections of a hank of fabric;

transport elements (6, 7) for each treatment chamber for progressively moving a section of the hank in one treatment chamber to the other treatment chamber;

balance means (11, 12) for pivotably balancing said chambers about a pendulum axis; and means (14, 15) responsive to an imbalance of said treatment chambers to adjust the rate of movement of a section of the hank from at least one treatment chamber to the other.

* * * * *